US006932595B1

(12) United States Patent
Booker

(10) Patent No.: US 6,932,595 B1
(45) Date of Patent: Aug. 23, 2005

(54) SAFETY COVER FOR BURNER DIALS OF A KITCHEN STOVE

(76) Inventor: Denise A. Booker, 3195 Niemi Dr., Harrison, MI (US) 48625

( * ) Notice: Subject to any disclaimer, the term of this patent is extended or adjusted under 35 U.S.C. 154(b) by 0 days.

(21) Appl. No.: 10/705,530

(22) Filed: Nov. 12, 2003

(51) Int. Cl.[7] ..... F23D 11/36
(52) U.S. Cl. ..... 431/153; 126/42; 126/211; 126/214 D
(58) Field of Search ..... 431/153; 126/42, 126/211, 214 D

(56) References Cited

U.S. PATENT DOCUMENTS

| | | | | | |
|---|---|---|---|---|---|
| 2,764,968 | A | * | 10/1956 | Shuster | 126/42 |
| 3,527,200 | A | * | 9/1970 | Voeke et al. | 126/42 |
| 3,556,624 | A | * | 1/1971 | Baltz et al. | 312/295 |
| 4,134,386 | A | | 1/1979 | Miguel | |
| 4,836,181 | A | * | 6/1989 | Saga | 126/42 |
| D306,119 | S | * | 2/1990 | Stockman et al. | D7/406 |
| 4,922,888 | A | * | 5/1990 | Bryan et al. | 126/42 |
| 5,040,162 | A | | 8/1991 | De Rozarieux et al. | |
| D325,249 | S | | 4/1992 | Kliebert | |
| D347,550 | S | | 6/1994 | Boone | |
| 5,357,942 | A | | 10/1994 | Williams et al. | |
| 5,438,974 | A | * | 8/1995 | Maldonado | 126/42 |
| 5,615,667 | A | | 4/1997 | Seeley et al. | |
| 6,371,105 | B1 | | 4/2002 | Merritt | |
| 6,526,963 | B2 | | 3/2003 | Hoshowski | |

* cited by examiner

*Primary Examiner*—Alfred Basichas
(74) *Attorney, Agent, or Firm*—John D. Gugliotta; Olen L. York, III

(57) ABSTRACT

A safety cover for burner dials of a stove is an apparatus that covers front-mounted control knobs or dials on stoves. The safety cover takes the shape of an elongated compartment that spans the width of the stove. The compartment is hinged along the bottom and connects to a square frame that is attached to the stove face via double sided foam adhesive tape or other appropriate adhesive means. When the safety cover is closed, it covers all front-mounted control knobs at once and is secured in the closed position at its top by one or two friction fit snap mounts. An adult user can simply release the snaps and open it in a downward manner to allow for easy and complete access to all knobs.

6 Claims, 4 Drawing Sheets

SAFETY COVER FOR BURNER DIALS OF A KITCHEN STOVE

RELATED APPLICATIONS

The present invention was first described in Disclosure Document Registration 529,684 filed on Apr. 10, 2003 under 35 U.S.C. §122, 37 C.F.R. §1.14 and MPEP § 1706. There are no previously filed, nor currently any co-pending applications, anywhere in the world.

BACKGROUND OF THE INVENTION

1. Field of the Invention

The present invention relates generally to safety covers, and more particularly, to a safety cover configured for use on a kitchen stove so as to cover the burner dials, thereby preventing unwanted or accidental tampering of the burner dials.

2. Description of the Related Art

Too often, a tragic house fire is caused by tampering of stove burner dials by children or the mentally impaired. While rear mounted burner controls are almost impossible for a child to reach, front mounted burner controls can be reached by almost any walking toddler. This is often a deadly combination when coupled with the fascination that toddlers have with knobs and dials. Even if parents or care givers carefully police the area around the stove, all it takes is one time and a few minutes alone for a catastrophe to result. Many parents who completely childproof their homes often overlook the stove as a potential disaster source, due to the fact that safety product manufacturers do not provide adequate or easy-to-use solutions for preventing access to stove controls. Accordingly, there is a need for a means by which access to front mounted stove burner controls can be restricted to young children and toddlers while allowing easy access for adults.

A search of the prior art did not disclose any patents that read directly on the claims of the instant invention; however, the following references were considered related:

U.S. Pat. No. 4,134,386, issued in the name of Miguel, discloses a stove switch cover lock comprising an elongated housing with a lock;

U.S. Pat. No. 4,157,705, issued in the name of Caan, discloses a range guard comprising an upstanding wall for preventing a person from accidentally touching a stove burner during or after use while still hot;

U.S. Pat. No. 5,040,162, issued in the name of De Rozarieux et al., discloses a cover device for controls comprising a pivotal window intermediate to two upstanding sidewalls;

U.S. Pat. No. 5,357,942, issued in the name of Williams et al., discloses a grease shield for range controls comprising a flexibly vinyl material having an edge mounted upon the range adjacent the burner controls, the shield overlying the burner controls;

U.S. Pat. No. 5,615,667, issued in the name of Seeley et al., discloses a splatter or grease guard comprising a substantially U-shaped apparatus attached to pivots mounted on the side of a stove;

U.S. Pat. No. 6,371,105, issued in the name of Merritt, discloses a stove burner shield with folding splash guards and locking control knob protective cover;

U.S. Pat. No. 6,526,963, issued in the name of Hoshowski, discloses a method and apparatus for protecting a stove control panel from splatter.

U.S. Pat. No. D 325,249, issued in the name of Kliebert, discloses an ornamental design for a splash guard; and U.S. Pat. No. D 347,550, issued in the name of Boone, discloses an ornamental design for an electric range control panel cover.

Consequently, there exists a continuous need for new ideas and enhancements for existing products in the burner dial industry.

SUMMARY OF THE INVENTION

It is therefore an object of the present invention to provide a safety cover for shielding and protection burner control dials of a kitchen stove from tampering, especially by children or the mentally impaired.

It is a feature of the present invention to provide a safety cover having a plate affixed to the surface of a kitchen stove on which the burner control dials are located.

It is a further feature of the present invention to provide a safety cover having a recessed compartment bay pivotally coupled to the plate, wherein the bay is pivotally rotated about a hinge mechanism to selectively open and close the bay in relation to the plate, thus allowing for covering of the burner control dials.

It is yet a further feature of the present invention to provide a safety cover having an extension for increasing the lateral width of the safety cover, the extension slidably affixed to the bay, wherein the extension is telescopically adjustable therein.

Briefly described according to one embodiment of the present invention, a safety cover for burner dials of a stove is an apparatus that covers front-mounted control knobs or dials on stoves. The safety cover takes the shape of an elongated compartment that spans the width of the stove. The compartment is hinged along the bottom and connects to a square frame that is attached to the stove face via double sided foam adhesive tape or other appropriate adhesive means. When the safety cover is closed, it covers all front-mounted control knobs at once and is secured in the closed position at its top by one or two friction fit snap mounts. An adult user can simply release the snaps and open it in a downward manner to allow for easy and complete access to all knobs.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
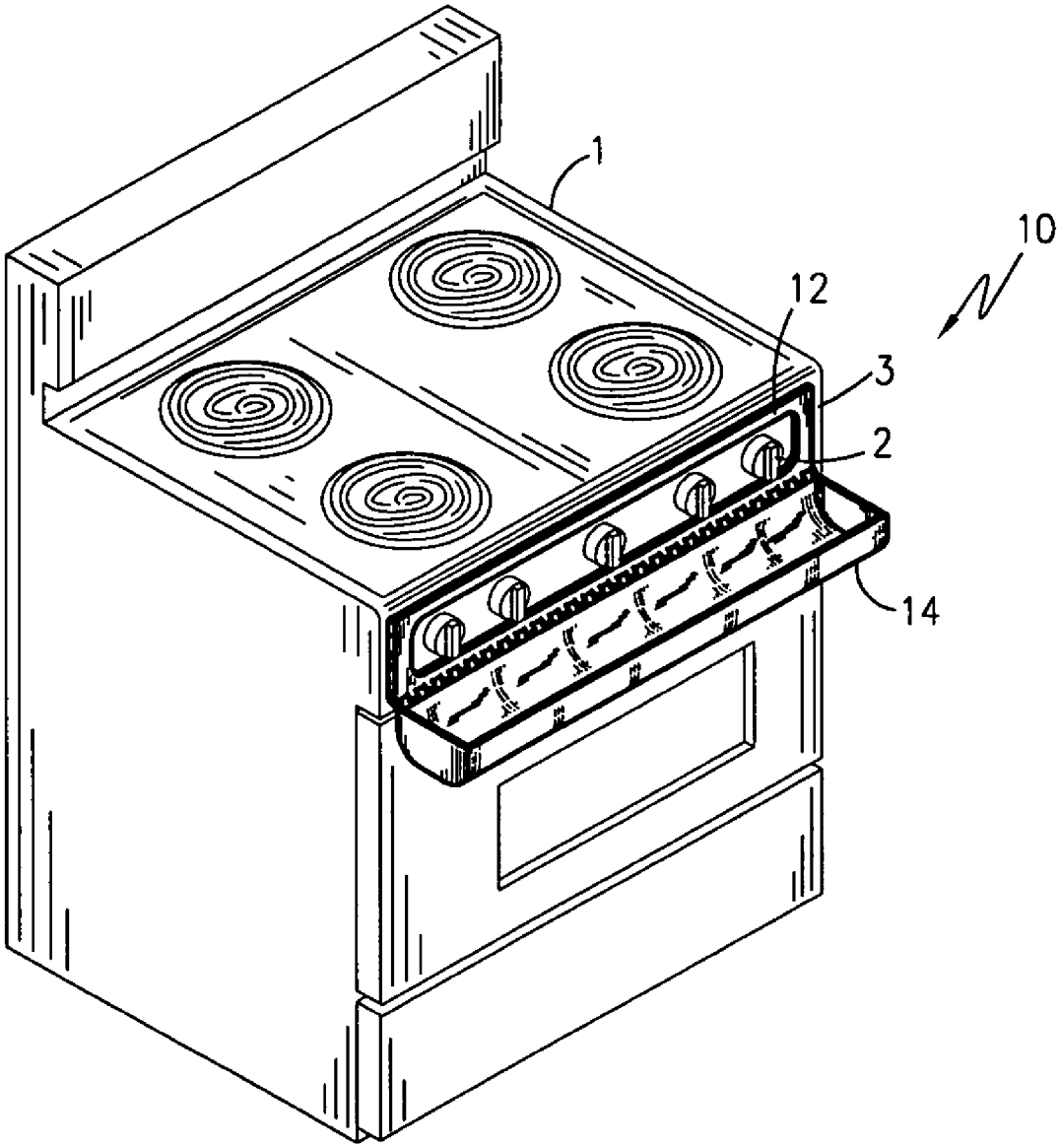
FIG. 1 is a perspective view of a kitchen stove 1 having a surface 3 through which a plurality of burner control dials 2 are housed, wherein a safety cover 10 for the burner control dials 2 is affixed to the surface 3 and the bay 14 is selectively opened to expose the dials 2.

The best mode for carrying out the invention is presented in terms of its preferred embodiment, herein depicted within FIGS. 1 through 6*b*.

1. Detailed Description of the Figures

Referring now to FIG. 1 through FIG. 5, a safety cover 10 for burner control dials 2 of a stove 1 is shown in accordance with a preferred embodiment of the present invention. The safety cover 10 comprises a laterally elongated rearward plate 12 pivotally coupled with a recessed compartment bay 14. The plate 12 and bay 14 are coupled about hinge means 16 of varying configurations. The plate 12 is affixed to a surface 3 that exposes the burner control dials 2, wherein the bay 14 pivotally rotates or swings about hinge means 16 for either shielding the burner control dials 2 or rotating/swinging open to expose the burner control dials 2 for use.

Figure 2:
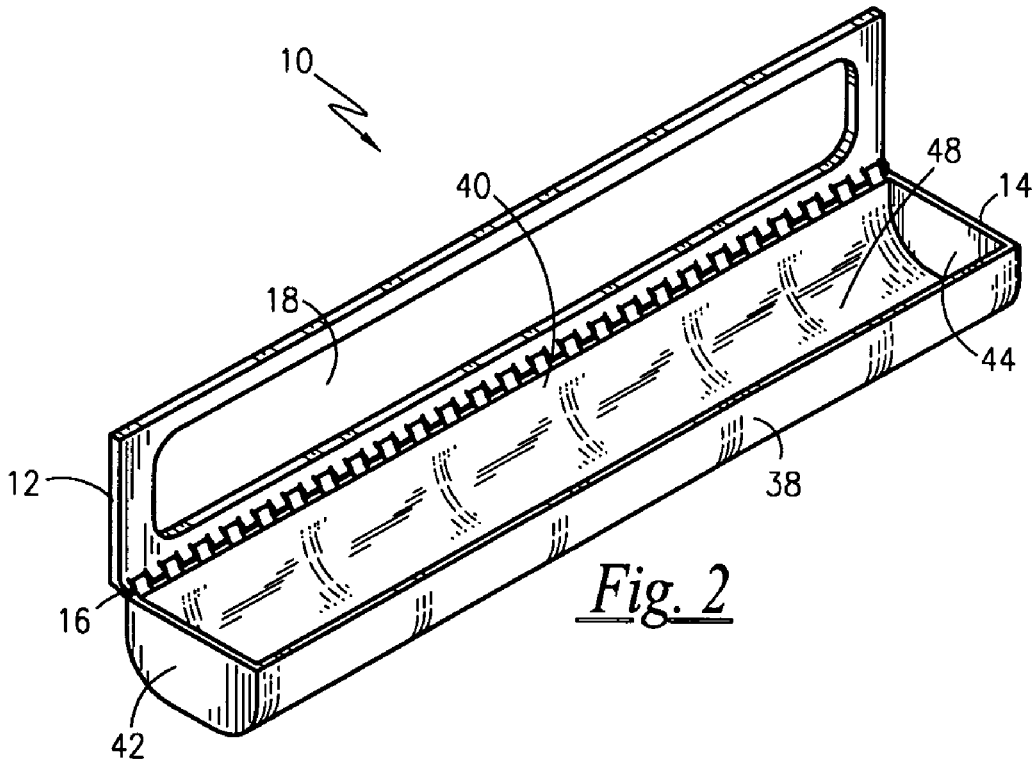
FIG. 2 is a perspective view of the safety cover 10 having a laterally elongated aperture 18.
Figure 3:
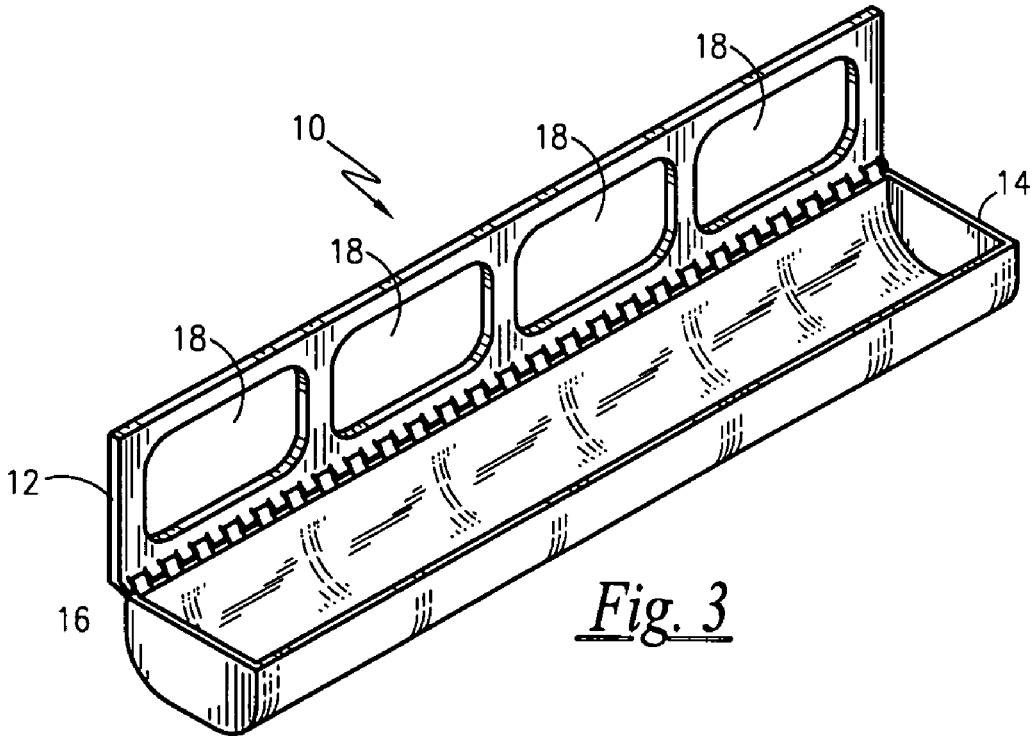
FIG. 3 is a perspective view of an alternate embodiment of the laterally elongated aperture 18 of FIG. 2, wherein a plurality of apertures 18 are provided.
Figure 4:
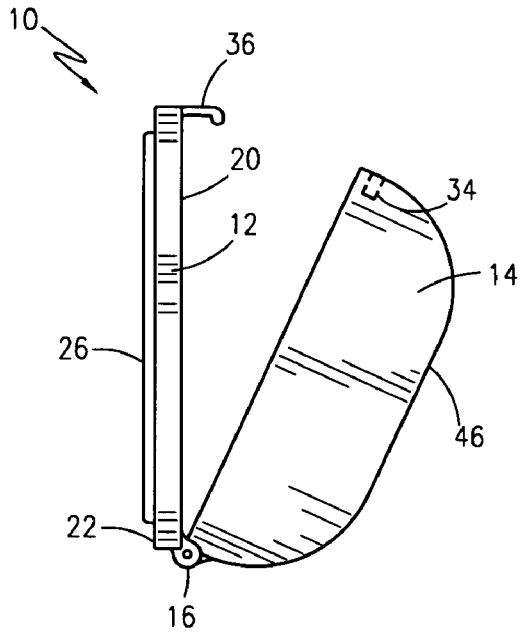
FIG. 4 is a side view of the safety cover 10 illustrating the adhesive pads 26 positioned on the posterior surface of plate 12, and the cooperative cavity 34 and hammer 36 provided to securely close the bay 14 to plate 12.
Figure 5:
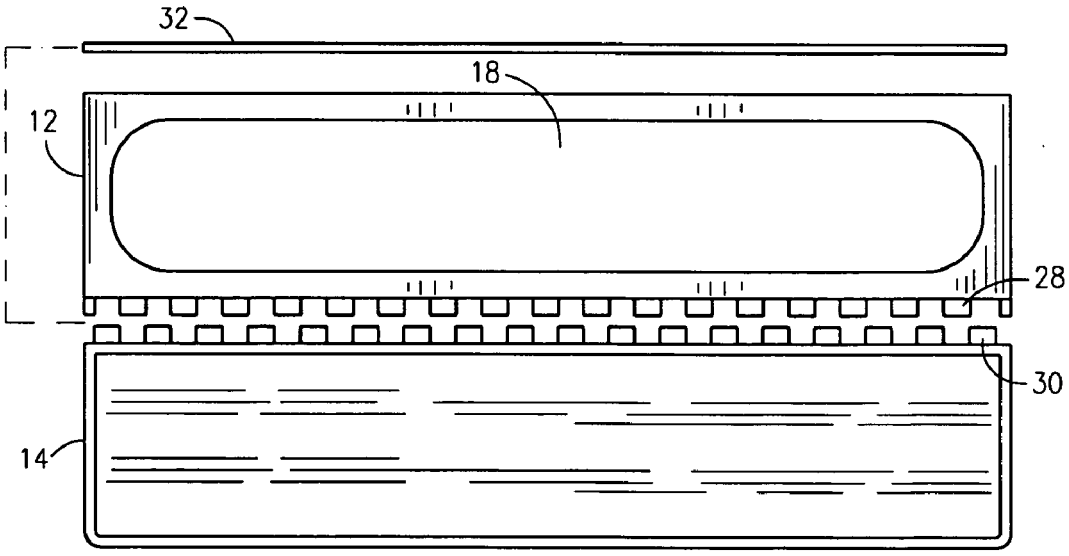
FIG. 5 is a front view of the plate 12 and the bay 14 separated to illustrate the piano hinge style complimentary coupling and dowel 32 used for coupling.

The plate 12 comprises a laterally elongated form intended to span the lateral width of the surface 3, with the plate 12 having an anterior surface 20 and a posterior surface 22 opposite surface 20. The plate 12 comprises at least one aperture 18 for allowing the burner control dials 2 to penetrate therethrough. The aperture 18 depicted in FIG. 2 is a laterally elongated aperture 18 dimensionally sized to accommodate every control burner dial 2 provided on the surface 3 of the stove 1. In an alternate embodiment, depicted in FIG. 3, the burner control dials 2 are exposed through a plurality of apertures 18 dimensionally sized to accommodate individual burner control dials 2 provided. The plate 12 is affixed to surface 3 by attachment means, which may include double sided adhesive pads 26, hook and loop material (with the hook material on one surface and the loop material on the other surface), brackets or other similar means. It is envisioned that the most cost effective and easily mountable means is the double sided adhesive pads 26, which would permit the user to remove the protective cover of the pads 26 and mount the pads 26 to the posterior surface 22 and then to the stove surface 3. At the junction between the plate 12 and the bay 14, the plate 12 comprises a plurality of cylinders 28 complimentary to a plurality of cylinders 30 formed on the bay 14. The cylinders 28 and 30 are cooperatively coupled and secured together in a hinged manner by a dowel 32 inserted therethrough. The form of this coupling between the cylinders 28 and 30 is similar to that of a piano hinge known in the art. However, it is further envisioned that other similar hinged mechanisms and arrangements may be used and incorporated into the present invention without departing from the scope and spirit of the present invention. By way of example, a plurality of hinges may be placed on the plate 12 and bay 14, connecting the plate 12 and bay 14 in a manner similar to a cabinet door to a cupboard. The plate 12 also includes locking means, envisioned as either a cavity 34 and a hammer 36 for selectively opening and closing the bay 14 in relation to the plate 12. In one embodiment, the plate 12 will house the cavity 34 and the bay 14 will house the hammer 36, thereby cooperatively engaging when the plate 12 and bay 14 are selectively closed upon one another. In an alternate embodiment, the plate 12 will house the hammer 36 and the bay 14 will house the cavity 34, also allowing for cooperative engagement of the cavity 34 and hammer 36. In either configuration, the hammer 36 is impinged within the cavity 34, thereby securely locking the bay 14 with the plate 12, and thus preventing tampering with the burner control dials 2. Other embodiment are also envisioned, including an orthogonal latch on the plate 12 with a tongue that fits into a groove formed on the bay 14, the tongue and groove impinged with one another in a manner similar to the cavity 34 and hammer 36.

The compartment bay 14 comprises a front wall 38, a rear wall 40 (opposite to and parallel with the front wall 38), and sidewalls 42 and 44, respectively, intermediate to the front and rear walls 38 and 40. A bottom wall 46 may also be provided for orthogonally coupled walls 38, 40, 42 and 44, depending on the geometric configuration of the front and rear walls 38 and 40 (for instance, if the front and rear walls 38 and 40 are curvilinear, as depicted in FIG. 2, then the walls 38 and 40 form a curvilinear bottom and a bottom wall is not required). The walls 38, 40, 42 and 44 (and 46, if required) form a recessed storage volume 48 within the bay 14. The bay 14 and storage volume 48 are provided to accommodate the thickness of the burner control dials 2, thus allowing the bay 14 to completely shield the burner control dials 2 when the bay 14 is pivotally rotated to the plate 12 and secured by the cavity 34 and hammer 36. As noted, the configuration of the bay 14 may be provided in a variety of geometric formations, including an arcuate or curvilinear form depicted, an orthogonal configuration, or other polygonal configurations. The variety of geometric configurations is intended to appeal to the aesthetic desires of the consumer and user.

Figure 6A:
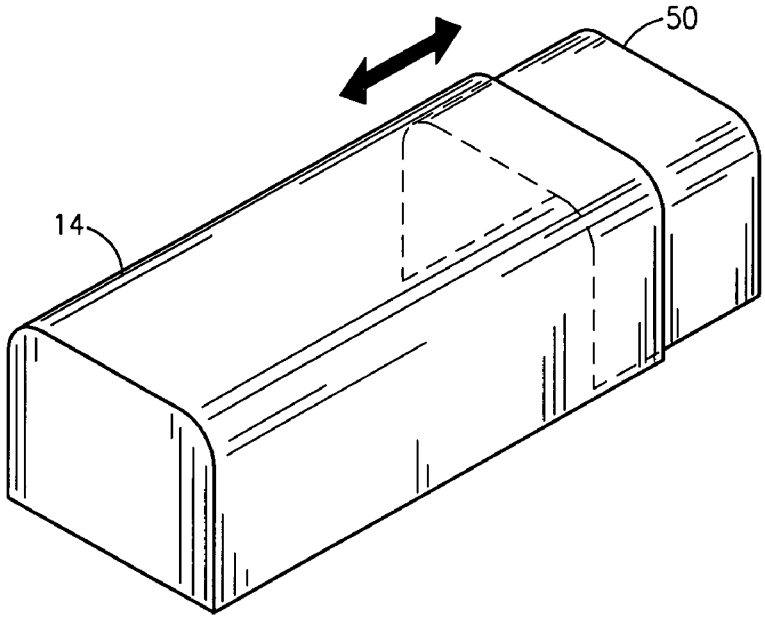
FIG. 6*a* is a perspective view of an orthogonal bay 14 with an extension 50 for extending the lateral width thereof.
Figure 6B:
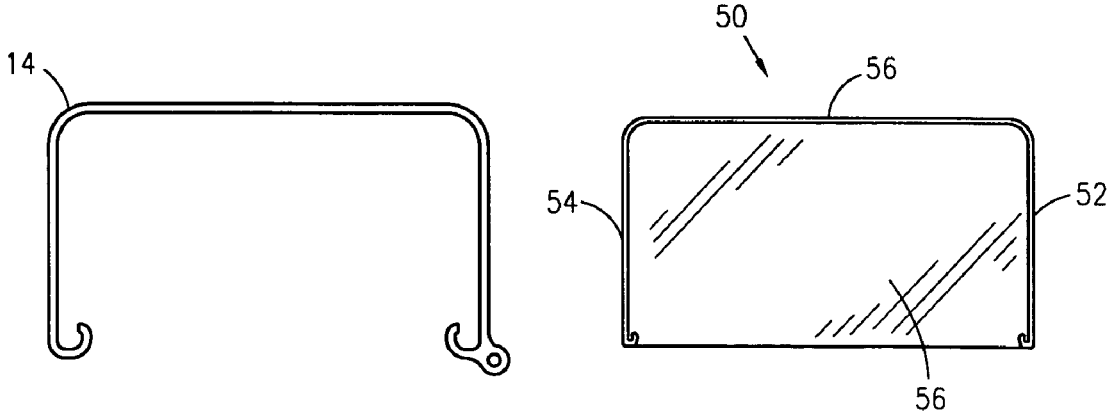
FIG. 6*b* is a side view of the bay 14 and the extension 50.

Now referring to FIG. 6*a* and FIG. 6*b*, an optional extension 50 may be provided to extend the lateral width that the safety cover 10 may span, thus providing versatility to the cover 10 in accommodating stoves of varying lateral widths. Without the extension 50, the cover 10 is intended to span a lateral width of approximately thirty (30) inches, or the standard width of most kitchen stoves. The extension 50 is provided to span approximately an additional six (6) to twelve (12) inches, which is intended to encompass the widths presently available. The extension 50 is formed of a front wall 52 coextensive with the front wall 38 of the bay 14, a rear wall 54 coextensive with the rear wall 40 of the bay 14, and a sidewall 56 intermediately therebetween, and a bottom wall 58 coextensive with a bottom wall of bay 14 if provided. The extension 50 is telescopically adjustable within the bay 14, comprising a continuation of the walls 38, 40, 42 and 44 (and 46, if necessary). The bay 14 depicted in FIG. 6*a* and FIG. 6*b* is an orthogonal configuration, wherein in FIG. 6*b*, the extension 50 is removed from bay 14 and shown side by side for illustrative purposes.

2. Operation of the Preferred Embodiment

To use the present invention, in accordance with a preferred embodiment of the present invention, a user will affix the plate 12 to the surface 3 on which the burner control dials 2 are found. The user will then pivotally rotate the bay 14 to shield the dials 2, and cooperatively impinging the cavity 34 and hammer 36 together, securing the bay 14 to the plate 12, thus preventing unwanted or accidental tampering of the dials 2.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A safety cover encasing burner control dials of a kitchen stove, said safety cover comprising:

a laterally elongated rearward plate attachable to a stove surface adjacent said burner control dials, said plate comprising at least one aperture to allow penetration of said burner control dials therethrough;

a compartment bay pivotally coupled with said plate about hinge means;

locking means cooperatively coupling said plate and said compartment bay;

wherein said compartment bay is pivotally rotated to conjoin with said plate to encase said burner control dials; and an extension for expanding the lateral width of said safety cover.

2. The safety cover of claim 1, said extension comprising a front wall, an opposing rear wall and a sidewall, said front wall and said rear wall telescopically adjustable within said bay.

3. The safety cover of claim 1, wherein said plate is attached to said stove surface adjacent said burner control dials via doubled sided adhesive pads affixed to a posterior surface of said plate.

4. The safety cover of claim 1, wherein said compartment bay comprises a recessed storage volume formed by upstanding adjacent walls, said recessed storage volume accommodating said burner control dials.

5. The safety cover of claim 1, wherein said hinge means comprises a plurality of plate cylinders complimentary conjoined with a plurality of bay cylinders, said plurality of plate cylinders and said plurality of bay cylinders cooperatively coupled via a dowel inserted therethrough.

6. The safety cover of claim 1, wherein said locking means comprises:

a hammer formed in said plate;

a cavity formed in said bay, said cavity cooperatively engaging said hammer to impinge said bay to said plate.

* * * * *